US007348959B2

(12) United States Patent
Kim

(10) Patent No.: US 7,348,959 B2
(45) Date of Patent: Mar. 25, 2008

(54) LIQUID CRYSTAL DISPLAY DEVICE

(75) Inventor: Eun-sup Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 581 days.

(21) Appl. No.: 10/849,549

(22) Filed: May 20, 2004

(65) Prior Publication Data

US 2005/0012702 A1 Jan. 20, 2005

(30) Foreign Application Priority Data

May 26, 2003 (KR) ..... 10-2003-0033342

(51) Int. Cl.
*G09G 3/36* (2006.01)

(52) U.S. Cl. ..... 345/102; 345/212; 345/698

(58) Field of Classification Search ..... 345/102, 345/211–213; 349/61; 713/300–340
See application file for complete search history.

(56) References Cited

U.S. PATENT DOCUMENTS 5,574,336 A 11/1996 Konopka et al. ..... 315/225
6,429,603 B1 8/2002 Tsugita et al. ..... 315/224
2001/0022584 A1* 9/2001 Tsugawa ..... 345/211
2001/0055009 A1* 12/2001 Zhang et al. ..... 345/204
2002/0003525 A1* 1/2002 Hwang ..... 345/102
2002/0021273 A1* 2/2002 Lee ..... 345/88

FOREIGN PATENT DOCUMENTS

JP 10-213789 8/1989
JP 2000-091091 3/2000
KR 2000-039790 12/1998
KR 2002-0041733 6/2002

* cited by examiner

*Primary Examiner*—Amr A. Awad
*Assistant Examiner*—Yong Sim
(74) *Attorney, Agent, or Firm*—Staas & Halsey LLP

(57) ABSTRACT

A liquid crystal display device including: a signal converter which converts a selectively input analog image signal into a digital image signal according to a sampling clock; a scaler which samples the digital image signal output by the signal converter, to render the digital image signal suitable for a resolution, according to the sampling clock, and generates a horizontal synchronization signal of the input analog image signal; a controller which detects the horizontal synchronization signal and generates the sampling clock according to the detected horizontal synchronization signal; an inverter which is synchronized with the digital image signal and which generates a pulse signal used to drive the backlight; and a panel driver which receives the sampled image signal from the scaler and displays the received signal.

30 Claims, 6 Drawing Sheets

LIQUID CRYSTAL DISPLAY DEVICE

CROSS-REFERENCE TO RELATED APPLICATION

This application claims the priority of Korean Patent Application No. 2003-33342, filed on May 26, 2003, in the Korean Intellectual Property Office, the disclosure of which is incorporated herein in its entirety by reference.

BACKGROUND OF THE INVENTION

1. Field of the Invention

The present invention relates to a liquid crystal display (LCD) device, and more particularly, to an LCD device which controls operations of backlights by comparing a power source for driving the backlights to a power source for driving a video processing board, the power sources being supplied separately from each other.

2. Description of Related Art

As demands for display devices increase, lower power consumption which is directly related to usable time of the device is researched actively. Especially, in case of the display device used in portable devices with screens, liquid crystal displays (LCD) are mainly used as the displays. The LCD device, which was developed for substituting a cathode ray tube (CRT), has advantages such as small size, light weight, and low power consumption, thus the LCD is also used in a large scale information display apparatus as well as in a laptop computer and a desktop computer.

Since the LCD device cannot illuminate itself, information is displayed by reflecting outer light passing through an LCD panel or by installing an additional light source, that is, a backlight assembly on a back surface of the LCD panel.

The backlight assembly includes a lamp unit for radiating the light, a light guide panel for guiding the light radiated from the lamp unit toward the LCD panel, and optical sheets for diffusing and condensing the light guided by the light guide panel to improve an efficiency of the light.

The lamp unit includes a lamp used as the light source of the LCD device, a reflecting panel for reflecting the light radiated from the lamp to improve the light efficiency, and an inverter connected to the lamp using a wire to apply a voltage to the lamp.

Recently, as LCD devices have become larger, a direct type LCD device, in which the backlight is directly installed on the LCD, has been used.

The number of backlights increases for forming higher brightness, thus power consumption of the backlights also increases. Therefore, since larger power consumption should be dealt with the low voltage of single power source, some problems such as power efficiency and heat generation are caused.

When a power source of the inverter and the power source of an image board are supplied independently, status information of the inverter is not transmitted to the image board, thus causing a phenomenon that the displayed state is continued even when the backlight power source in the inverter is turned off. Especially, the backlight which consumes more electric power than the image board, is turned off earlier than the image board when the power source is turned on right after the power source is turned off due to an instant electric failure. In addition, when the power source is turned on before the image board is reset (the power source is turned on after the electric failure), the display is made in a state that the power source of the backlight is turned off.

BRIEF SUMMARY

The present invention provides a liquid crystal display device, which controls turning-on and turning-off of backlights by comparing a power source for driving the backlight to a power source for driving a video processing board which are supplied separately.

According to an aspect of the present invention, there is provided a liquid crystal display device including: a signal converter which converts a selectively input analog image signal into a digital image signal according to a sampling clock; a scaler which samples the digital image signal output by the signal converter, to render the digital image signal suitable for a resolution, according to the sampling clock, and generates a horizontal synchronization signal of the input analog image signal; a controller which detects the horizontal synchronization signal and generates the sampling clock according to the detected horizontal synchronization signal; an inverter which is synchronized with the digital image signal and which generates a pulse signal used to drive the backlight; and a panel driver which receives the sampled image signal from the scaler and displays the received signal.

The inverter unit may include: a comparer which compares a first power source supplied to the panel driver with a second power source that is supplied separately from the first power source, and which outputs a comparing result signal; an inverter controlling pulse width modulator which generates a pulse width modulation signal synchronized with the horizontal synchronization signal, and is turned on or off according to the comparing result signal; a switching transformer which switches on or off the power source according to the pulse signal; and a backlight which radiates light when powered by the power source.

According to another aspect of the present invention, there is provided a liquid crystal display device including: a signal converter which converts a selectively input analog image signal into a digital image signal according to a sampling clock; a scaler which samples the digital image signal output by the signal converter, to render the digital image signal suitable for a resolution, according to the sampling clock, and generates a horizontal synchronization signal of the input analog image signal; a comparer which compares a first power supplied to the panel driver with a second power that is supplied separately from the first power, and which outputs a comparing result signal; a controller which detects the horizontal synchronization signal and generates the sampling clock according to the detected horizontal synchronization signal; an inverter which is synchronized with the digital image signal and which generates a pulse signal used to drive a backlight; and a panel driver which receives the sampled image signal from the scaler and displays the received signal on a liquid crystal panel. The controller outputs inverter on/off signals which turn the inverter on and off, respectively, according to the comparing result signal.

According to another aspect of the present invention, there is provided a method of improving an efficiency of an LCD illuminated by a backlight, including: comparing a first power for driving the backlight to a second power for driving a video processing board which controls a display of an image on the LCD; and turning-on/turning-off a backlight continuous in accordance with the comparing result, wherein the second power source is separate from the first power source.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENTS

Figure 1:
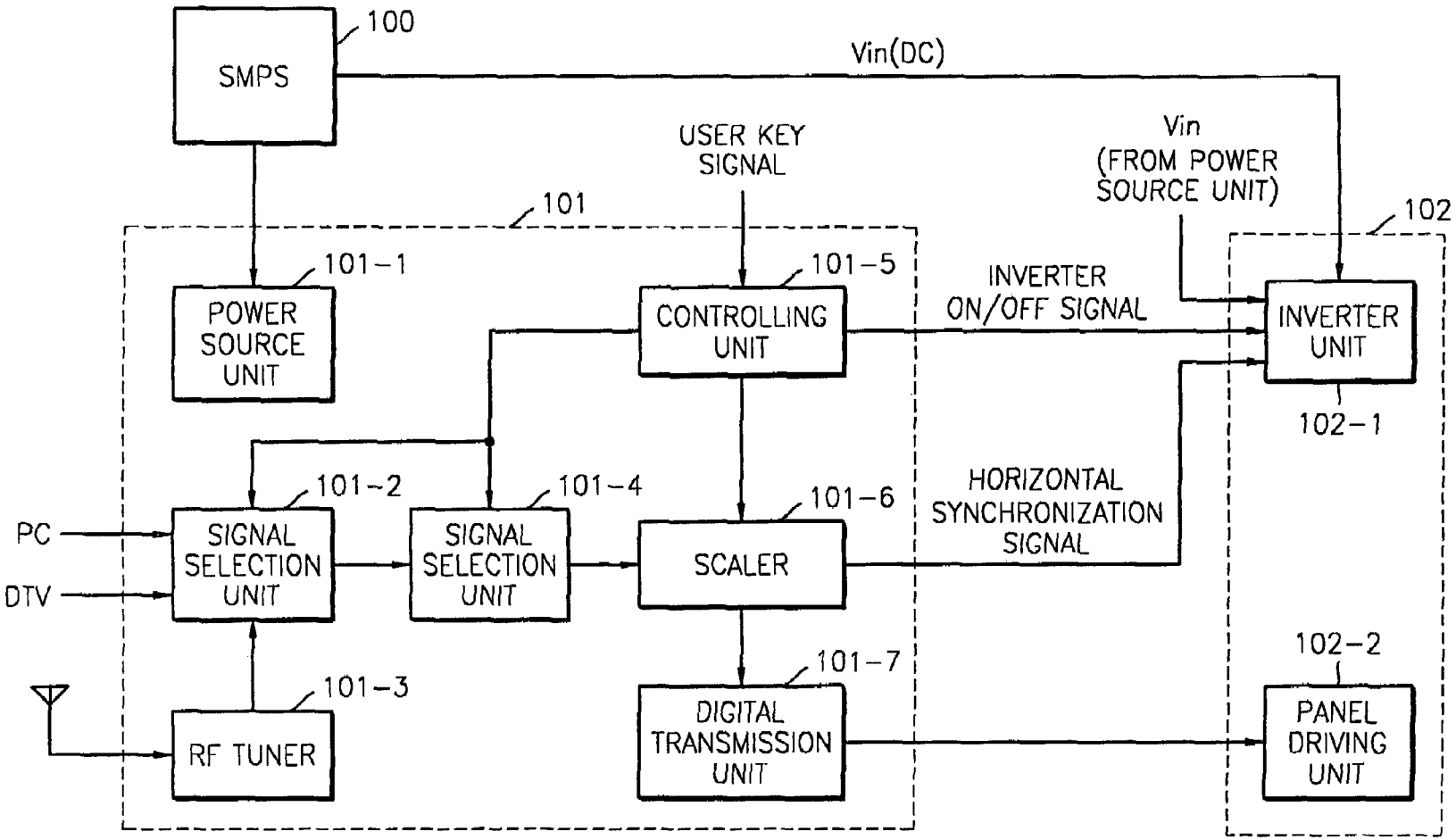
FIG. 1 is a block diagram of a configuration of a liquid crystal display device according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram of a configuration of a liquid crystal display (LCD) device according to a first embodiment of the present invention. The LCD device includes a switching mode power supply (SMPS) 100, a video processing board 101, and an LCD panel 102. The video processing board 101 includes a power source unit 101-1, a signal selection unit 101-2, a radio frequency (RF) tuner 101-3, a signal conversion unit 101-4, a controlling unit 101-5, a scaler 101-6, and a digital transmission unit 101-7. The LCD panel includes an inverter unit 102-1, a panel driving unit 102-2, and a backlight 102-3 (shown in FIG. 2).

Figure 2:
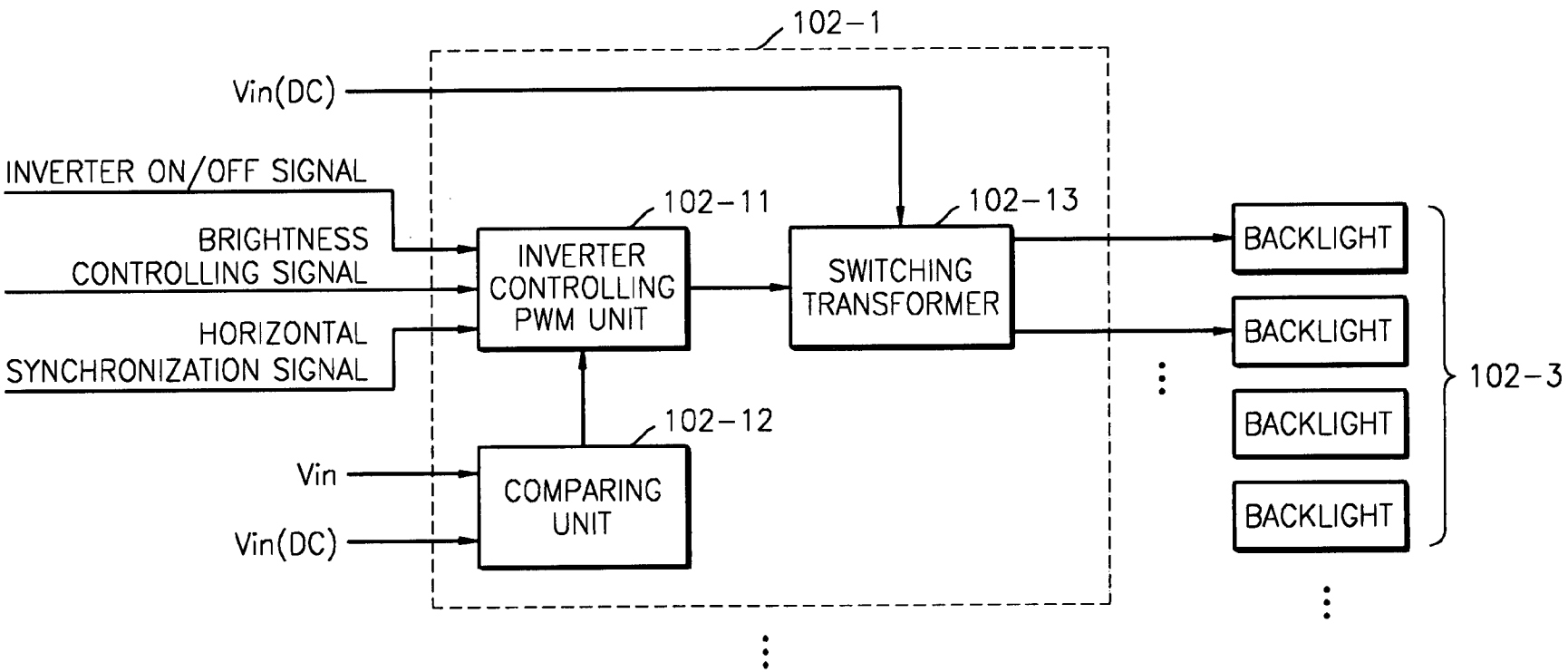
FIG. 2 is a detailed view of an inverter unit in FIG. 1.

FIG. 2 is a detailed view of the inverter unit 102-1 of FIG. 1. The inverter unit 102-1 includes an inverter controlling pulse width modulation (PWM) unit 102-11, a comparing unit 102-12, and a switching transformer 102-13.

Figure 3:
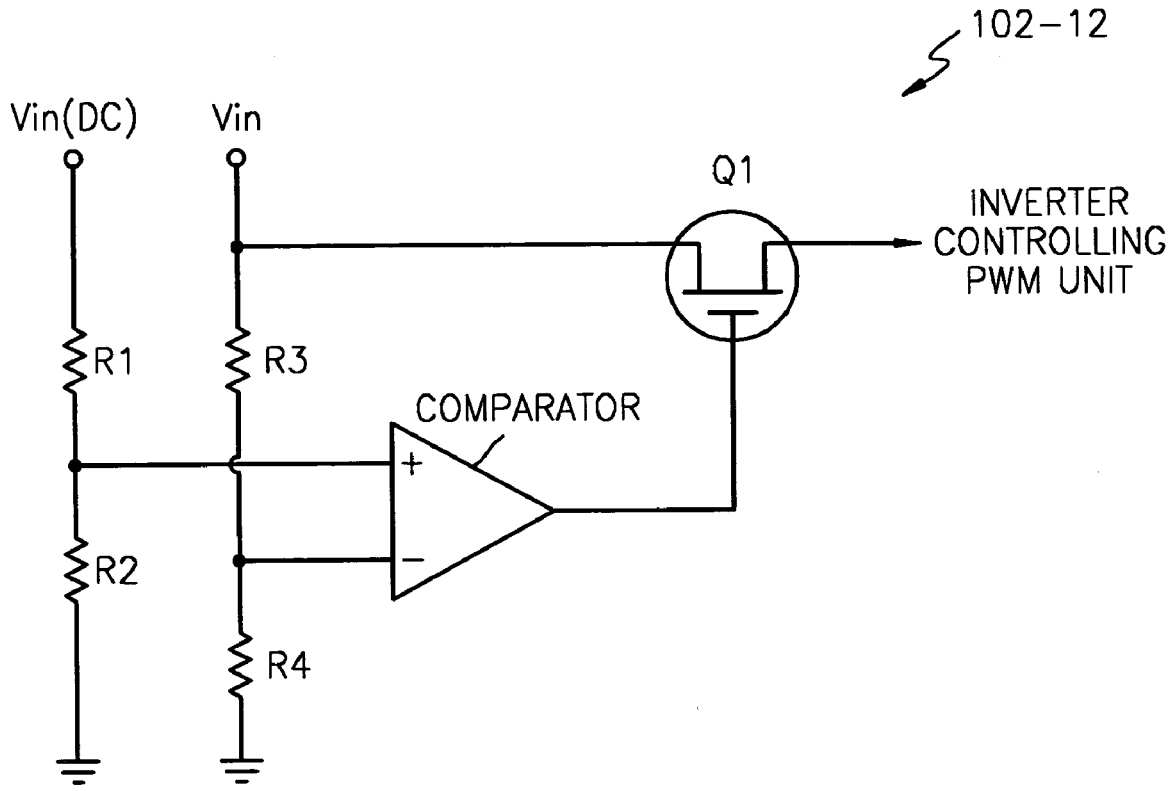
FIG. 3 is a detailed view of a comparing unit in FIG. 2.

FIG. 3 is a detailed view of the comparing unit 102-12 in FIG. 2.

The present embodiment will be described with reference to FIGS. 1 through 3.

The SMPS 100 generates a first power source (Vin) driving the video processing board 101 and a second power source (Vin(DC)) input into the switching transformer 102-13 for driving the backlight 102-3. The video processing board 101 is operated with a low voltage of 5V~12V, and the backlight 102-3 is operated with a high voltage of 120V. The SMPS 100 generates the first and second power sources separately in order to provide the two different voltages.

The video processing board 101 processes an input video signal.

The power source unit 101-1 generates a power source for driving the video processing board 101 with the first power source supplied from the SMPS 100.

The signal selection unit 101-2 selects a desired signal, for example, a PC signal, a DTV signal, or one of R/G/B image signals, an RF signal, or CVBS signals generated from the RF tuner 101-3 according to a selection signal of the controlling unit 101-5.

The signal conversion unit 101-4 converts the signal selected in the signal selection unit 101-2 into a digital image signal by sampling the signals according to a sampling clock supplied from the controlling unit 101-5.

The scaler 101-6 performs an up-sampling or a down-sampling operation of the digital image signal input from the signal conversion unit 1014 to correspond to a resolution of the panel using a clock pulse generated in the controlling unit 101-5. Also, the scaler 101-6 generates a horizontal synchronization signal of the sampled image signal.

The controlling unit 101-5 receives a user selected key signal and applies the selection signal to the signal selection unit 101-2, and discriminates the display mode by detecting a horizontal or a vertical synchronization signal from the signal selected in the signal selection unit 101-2. Also, the controlling unit 101-5 applies the sampling clock to the signal conversion unit 1014 and the scaler 101-6 so that the signal is processed according to the display mode, and receives the user selected key signal and applies the selection signal to the signal selection unit 101-2. In addition, the controlling unit 101-5 generates inverter on/off signals for turning on/off the inverter operation according to an outer selection condition.

The digital transmission unit 101-7 transmits the digital image signal converted in the scaler 101-6 in a low voltage differential signal (LVDS) format.

The LCD panel 102 receives the signal from the video processing board 101 and displays it.

The inverter unit 102-1 generates a PWM signal synchronized with the horizontal synchronization signal generated in the scaler 101-6, and drives the backlight 102-3 using the PWM signal. The inverter unit 102-1 is turned on/off according to a result of comparing the first and second power sources output from the SMPS 100.

The panel driving unit 102-2 displays the digital signal, which is transmitted from the digital transmission unit 101-7 in the LVDS format, on the liquid crystal panel. That is, the panel driving unit 102-2 performs on/off switching operations to drive the LCD panel by inputting scaled image data or gain-controlled image data into the LCD panel or generates a driving signal corresponding to the brightness of the image data.

Referring to FIGS. 2 and 3, the inverter controlling PWM unit 102-11 synchronizes with the horizontal synchronization signal output from the scaler 101-6 of the video processing board 101 to generate a PWM signal, and is turned on/off according to the inverter on/off signals generated in the controlling unit 101-5 of the video processing board 101. For example, a falling edge or a rising edge of the horizontal synchronization signal is synchronized with a falling edge or a rising edge of the PWM signal. Also, the inverter controlling PWM unit 102-11 receives a brightness controlling signal to control the brightness of the backlight 102-3. However, the operation of the inverter controlling PWM unit 102-11 is controlled by the comparing result signal of the comparing unit 102-12.

The comparing unit 102-12 compares the first power source transmitted from the video processing board 101 to the second power source input into the switching transformer 102-13 from the SMPS 100 for driving the backlight 102-3. The comparing unit 102-12 uses the first power source as a reference value.

FIG. 3 is a detailed view of the comparing unit 102-12. A comparator compares the first power source (Vin) divided by resistances R3 and R4 to the second power source (Vin(DC))

divided by resistances R1 and R2, and turns on/off the inverter controlling PWM unit 102-11 according to the compared result.

When the first power source is smaller than the second power source, the comparator outputs a high signal to turn Q1 on. When Q1 is turned on, the first power source is input into the inverter controlling PWM unit 102-11, and the inverter controlling PWM unit 102-11 is turned on. However, when the first power source is larger than the second power source, the comparator outputs a low signal to turn Q1 off. When Q1 is turned off, the first power source is not input into the inverter controlling PWM unit 102-11, and the inverter controlling PWM unit 102-11 is in the turn-off status.

When the inverter controlling PWM unit 102-11 is operated when the second power source is not set, the PWM duty which is generated in the inverter controlling PWM unit 102-11 for supplying more power to the backlight 102-3 is excessively generated and a shut-down phenomenon happens. For preventing the shut-down phenomenon, the power source (first power source) input into the inverter controlling PWM unit (102-11) is blocked until the second power source becomes larger than the first power source.

Also, in an instant electric failure, the backlight power source (second power source) having larger power consumption is discharged rapidly. Therefore, when the second power source becomes smaller than the first power source, the operating power source of the inverter controlling PWM unit 102-11 is blocked by Q1, and when a stable second power source is applied, the inverter controlling PWM unit 102-11 is reset and reoperated to prevent the continued backlight 102-3 turning-off phenomenon.

The switching transformer 102-13 is operated by the second power source, that is, the backlight power source (Vin(DC)) input from the SMPS 100, and generates DC switching power source according to PWM signal input from the inverter controlling PWM unit 102-11.

The backlight 102-3 radiates the light using the switching power applied from the switching transformer 102-13.

Figure 4:
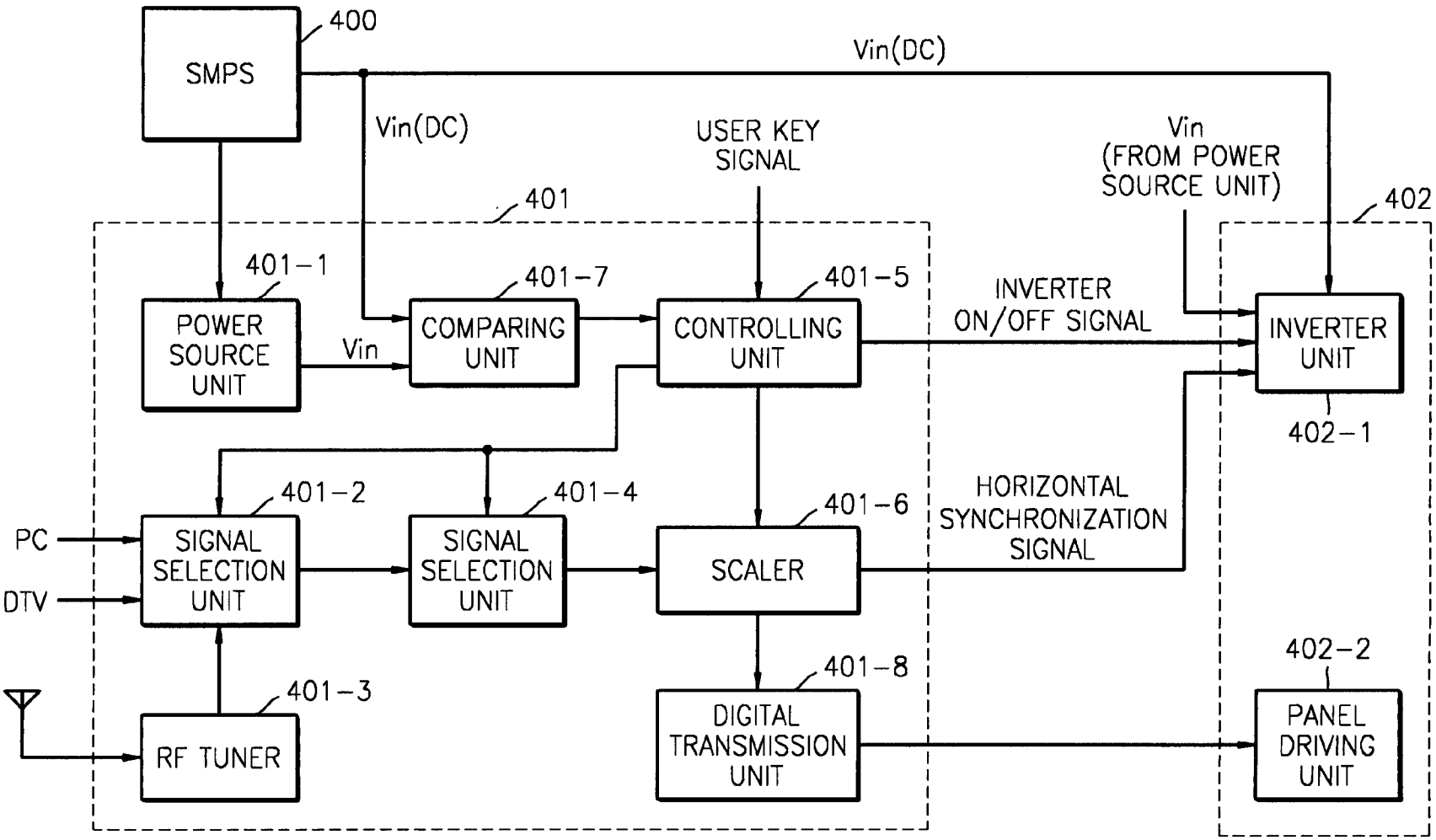
FIG. 4 is a block diagram of a configuration of a liquid crystal display device according to another embodiment of the present invention.

FIG. 4 is a block diagram of a configuration of an LCD device according to a second embodiment of the present invention, and the LCD device includes an SMPS 400, a video processing board 401, and an LCD panel 402. The video processing board 401 includes a power source unit 401-1, a signal selection unit 401-2, an RF tuner 401-3, a signal conversion unit 401-4, a controlling unit 401-5, a scaler 401-6, a comparing unit 401-7, and a digital transmission unit 401-8. The LCD panel of the present invention includes an inverter unit 402-1, a panel driving unit 402-2, and a backlight 402-3.

Figure 5:
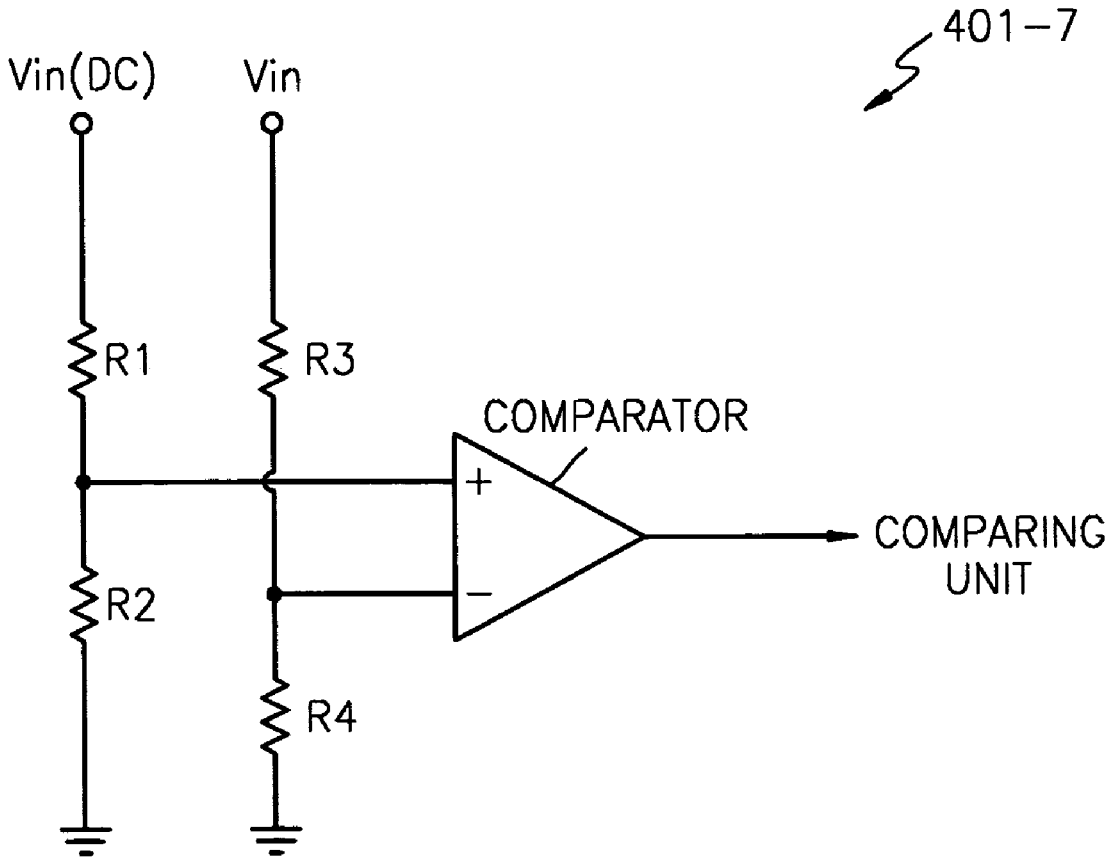
FIG. 5 is a detailed view of a comparing unit in FIG. 4.
Figure 6:
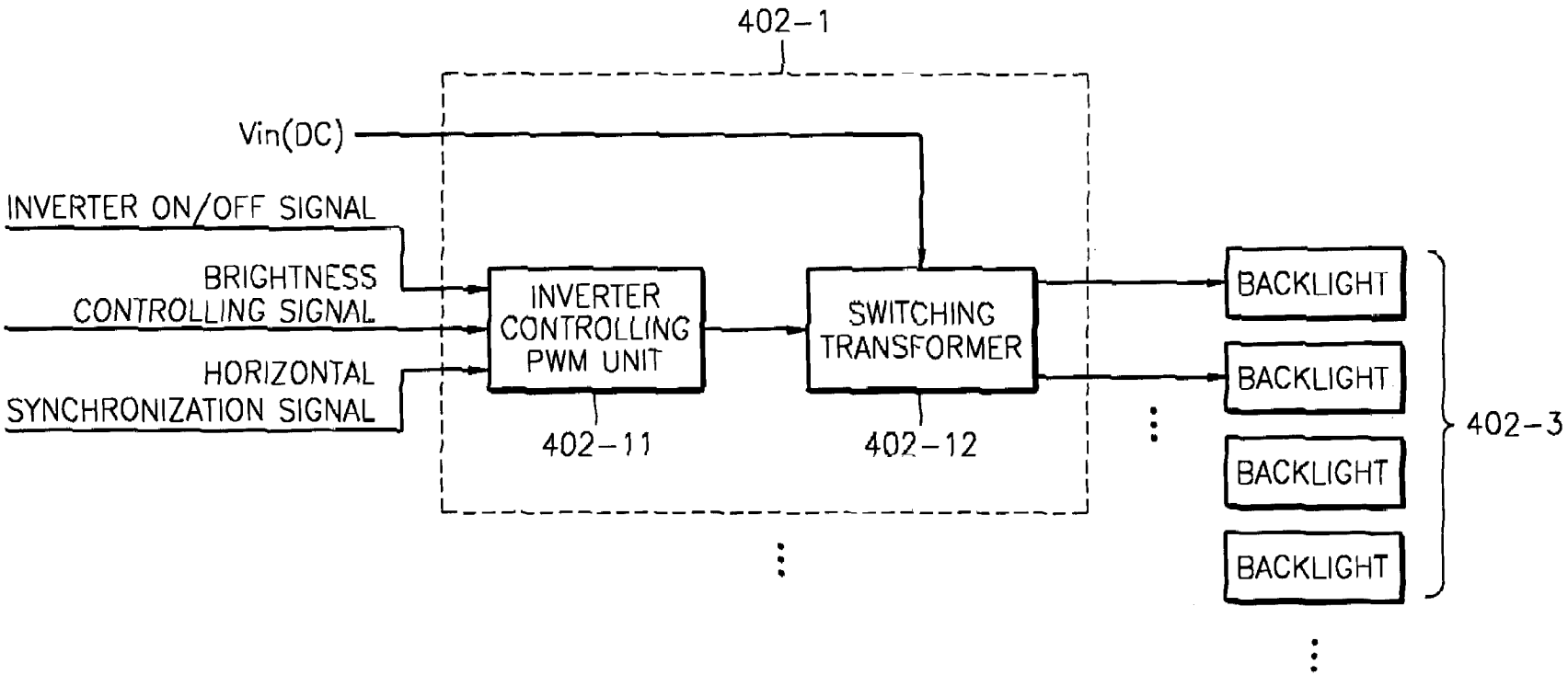
FIG. 6 is a detailed view of an inverter unit in FIG. 4.

FIG. 5 is a detailed view of the comparing unit 401-7 in FIG. 4. FIG. 6 is a detailed view of the inverter unit 402-1 in FIG. 4, and the inverter unit 402-1 includes an inverter controlling PWM unit 402-11, and a switching transformer 402-12.

The present embodiment will be described with reference to FIGS. 4 through 6.

The SMPS 400 generates first power source (Vin) driving the video processing board 401 and second power source (Vin(DC)) input into a switching transformer 402-12 for driving the backlight 402-3. The video processing board 401 is operated by a low voltage of 5V~12V, and the backlight 402-3 is operated by a high voltage of 120V. The SMPS 400 generates the first power source and the second power source separately to provide the two different voltage conditions.

The video processing board 401 processes an input video signal. The power source unit 401-1 generates a power source for driving the video processing board 401 using the first power source input from the SMPS 400.

The signal selection unit 401-2 selects a desired signal, for example, one of a PC signal, DTV signal, R/G/B image signals or RF signal generated in RF tuner 401-3, and CVBS signals according to a selection signal of the controlling unit 401-5.

The signal conversion unit 4014 converts the signal selected in the signal selection unit 401-2 into a digital image signal by sampling those signals according to a sampling clock supplied from the controlling unit 401-5.

The scaler 401-6 performs up-sampling or down-sampling operation of the digital RGB image signal input from the signal conversion unit 4014 using a clock pulse generated in the controlling unit 401-5 according to the controlling signal of the controlling unit 401-5 to make the signal suitable for the resolution of the panel, and generates a horizontal synchronization signal of the sampled image signal.

The controlling unit 401-5 receives a user-selected key signal and applies the selection signal to the signal selection unit 401-2, and discriminates the display mode by detecting horizontal or vertical synchronization signal from the signal selected in the signal selection unit 401-2. Also, the controlling unit 401-5 applies the sampling clock to the signal conversion unit 401-4 and the scaler 401-6 so that the signal is processed according to the display mode, and receives the user selected key signal and applies the selection signal to the signal selection unit 401-2.

Also, the controlling unit 401-5 generates inverter on/off signals for turning on/off the inverter according to the result of comparison in the comparing unit 401-7. The comparing unit 401-7 may be included is includable in the video processing board 401 as shown in FIG. 4, and may be disposable on an outer side of the video processing board 401. The comparing unit 401-7 compares the first power source transmitted from the power source unit 401-1 to the second power source input into the switching transformer 402-13 from the SMPS 400 for driving the backlight 402-3. The comparing unit 401-7 uses the first power source as a reference value.

FIG. 5 is a detailed view of the comparing unit 401-7. A comparator compares the first power source (Vin) divided by resistances R3 and R4 to the second power source (Vin(DC)) divided by resistances R1 and R2, and turns on/off the inverter controlling PWM unit 102-11 according to the compared result. When the first power source is smaller than the second power source, the comparator outputs a high signal. When the comparator outputs the high signal, the controlling unit 401-5 receives the signal and turns the inverter unit 402-1 on. However, when the first power source is larger than the second power source, the comparator outputs a low signal. When the comparator outputs a low signal, the controlling unit 401-5 receives the signal and turns the inverter unit 402-1 off.

The digital transmission unit 401-8 transmits the digital image signal converted in the scaler 401-6 in an LVDS format.

The LCD panel 402 receives the signal from the video processing board 401 and displays it.

The inverter unit 402-1 outputs a PWM signal as synchronizing with the horizontal synchronization signal generated in the scaler 401-6, operates the backlight 402-3 using the PWM signal, and is turned on/off according to the control of the controlling unit 401-5.

The panel driving unit 402-2 displays the digital RGB signal, which is transmitted from the digital transmission unit 401-8 in the LVDS format, on the liquid crystal panel. That is, the panel driving unit 402-2 performs on/off switching operations so as to drive the liquid crystal panel by inputting scaled image data or gain-controlled image data into the liquid crystal panel, or generates a driving signal corresponding to the brightness of the image data.

Referring to FIG. 6, an inverter controlling PWM unit 402-11 synchronizes with the horizontal synchronization signal output from the scaler 401-6 of the video processing board 401 to generate the PWM signal, and is turned on/off according to the inverter on/off signals generated in the controlling unit 401-5 of the video processing board 401. For example, a falling edge or a rising edge of the horizontal synchronization signal is synchronized with a falling edge or a rising edge of the PWM signal. Also, the inverter controlling PWM unit 402-11 receives a brightness controlling signal and controls the brightness of the backlight 402-3.

If the inverter controlling PWM unit 402-11 is operated when the second power source is not set, PWM duty generated by the inverter controlling PWM unit 402-11 for supplying more power to the backlight 402-3 is excessively formed and a shut-down phenomenon happens. In order to prevent the shut-down phenomenon, the controlling unit 401-5 blocks the power source input into the inverter controlling PWM unit 402-11 (first power source) until the second power source becomes larger than the first power source, when the liquid crystal panel is initially operated.

Also, in an instant electric failure, the power source (second power source) of the backlight 402-3 having larger power consumption is discharged rapidly. Therefore, when the second power source becomes smaller than the first power source, the controlling unit 401-5 turns the inverter unit 402-1 off to block the operating power source of the inverter controlling PWM unit 402-11. When a stable second power source is applied, the inverter controlling PWM unit 402-11 is reset to prevent the backlight 402-3 turning-off phenomenon.

The switching transformer 402-12 is operated by the second power source, that is, the backlight power source (Vin(DC)) input from the SMPS 400, and generates DC switching electric power according to the PWM signal input from the inverter controlling PWM unit 402-11.

The backlight 402-3 radiates the light with the switching electric power applied from the switching transformer 402-11.

As described above, continuous turning-on/turning-off of the backlight is controlled by comparing the power source for driving the backlight to the power source for driving the video processing board which are supplied separately, thus improving the efficiency of the LCD.

Although a few embodiments of the present invention have been shown and described, the present invention is not limited to the described embodiments. Instead, it would be appreciated by those skilled in the art that changes may be made in these embodiments without departing from the principles and spirit of the invention, the scope of which is defined by the claims and their equivalents.

What is claimed is:

1. A liquid crystal display device comprising:

a signal converter which converts a selectively input analog image signal into a digital image signal according to a sampling clock;

a scaler which samples the digital image signal output by the signal converter, to render the digital image signal suitable for a resolution, according to the sampling clock, and generates a horizontal synchronization signal of the input analog image signal;

a controller which detects the horizontal synchronization signal and generates the sampling clock according to the detected horizontal synchronization signal;

an inverter which is synchronized with the digital image signal and which generates a pulse signal usable to drive a backlight; and a panel driver which receives the sampled image signal from the scaler and displays the received signal, wherein the inverter comprises:

a comparer which compares a first power supplied to the panel driver with a second power that is supplied separately from the first power, and which outputs a comparing result signal;

an inverter controlling pulse width modulator which generates a pulse width modulation signal synchronized with the horizontal synchronization signal, and is turned on or off according to the comparing result signal;

a switching transformer which switches on or off a power source according to the pulse width modulation signal; and the backlight which radiates light when powered by the power source.

2. The device of claim 1, further comprising a switching mode power supply (SMPS) which separately generates the first power and the second power.

3. The device of claim 1, further comprising an RF tuner which generates the input analog signal according to a selection signal from the controller.

4. The device of claim 1, further comprising a signal selector which selects the input analog image signal.

5. The device of claim 4, wherein the input analog image signal is one of a PC signal, a DTV signal, an R/G/B image signal, an RF signal, and a CVBS signal.

6. The device of claim 1, further comprising a digital transmitter which transmits the digital image signal to the panel driver.

7. The device of claim 6, wherein the digital transmitter transmits the digital image in a low voltage differential signal (LVDS) format.

8. The device of claim 7, wherein the panel driver displays the transmitted digital image on a liquid crystal display (LCD) panel by performing on/off switching operations to drive the LCD panel by one of inputting scaled image data into the LCD panel, inputting gain-controlled image data into the LCD panel, and generating driving signal corresponding to the brightness of the image data.

9. The device of claim 1, wherein the signal converter, the scaler, and the converter comprise a video processing board.

10. The device of claim 9, wherein the first power drives the video processing board.

11. The device of claim 9, wherein the video processing board operates at a voltage of between about 5V to 12V.

12. The device of claim 1, further comprising:

a video processing board which includes the signal converter, the scaler, and the controller; and a power source unit which generates power from the first power to drive the video processing board.

13. The device of claim 1, wherein the inverter and the panel driver comprise an LCD panel.

14. The device of claim 1, wherein the backlight operates at a voltage of 120V.

15. The device of claim 2, wherein the comparer includes a comparator which compares the first power divided by resistances R3 and R4 with the second power divided by resistances R1 and R2, and turns the inverter on/off according to the compared result.

16. The device of claim 15, wherein, the comparer includes a transistor and the comparer turns the inverter on/off by turning the transistor on/off, respectively.

17. The device of claim 16, wherein, when the first power is less than the second power, the comparator outputs a high signal to turn the transistor on, when the first power is greater than the second power, the comparator outputs a low signal to turn the transistor off, when the transistor is on, the inverter is turned on, and when the transistor is turned off, the inverter is turned-off.

18. The device of claim 1, wherein the inverter operates the inverter when the second power is greater than the first power and outputs a signal used for suspending the operation of the inverter controlling pulse width modulation when the second power is less than the first power.

19. The device of claim 18, wherein the first power is a reference value.

20. A liquid crystal display device comprising:

a signal converter which converts a selectively input analog image signal into a digital image signal according to a sampling clock;

a scaler which samples the digital image signal output by the signal converter, to render the digital image signal suitable for a resolution, according to the sampling clock, and generates a horizontal synchronization signal of the input analog image signal;

a comparer which compares a first power supplied to the panel driver with a second power that is supplied separately from the first power, and which outputs a comparing result signal;

a controller which detects the horizontal synchronization signal and generates the sampling clock according to the detected horizontal synchronization signal;

an inverter which is synchronized with the digital image signal and which generates a pulse signal used to drive a backlight; and a panel driver which receives the sampled image signal from the scaler and displays the received signal on a liquid crystal panel, wherein the controller outputs inverter on/off signals which turn the inverter on and off, respectively, according to the comparing result signal.

21. The device of claim 20, wherein the comparer includes a comparator which compares the first power the divided by resistances R3 and R4 with the second power divided by resistances R1 and R2, and turns the inverter on/off according to the compared result.

22. The device of claim 21, wherein, when the first power is less than the second power, the comparator outputs a high signal, when the first power is greater than the second power, the comparator outputs a low signal, when the comparator outputs the high signal, the controller turns the inverter on, and when the comparator outputs a low signal, the controller turns the inverter off.

23. The device of claim 21, wherein, when the inverter is operated and the second power is not set, the first power is not input into the inverter until the second power is greater than the first power.

24. The device of claim 20, wherein the controlling unit outputs a controlling signal for operating the inverter unit in a case where the second power is greater than the first power, and outputs a controlling signal for suspending the operation of the inverter when the second power is less than the first power.

25. The device of claim 24, wherein the first power is a reference value.

26. The device of claim 24, wherein, when the operation of the inverter is suspended, the inverter is reset when a stable second power is thereafter applied to the inverter.

27. The device of claim 20, wherein the inverter synchronizes with the horizontal synchronization signal and is turned on/off according to the inverter on/off signals generated by the controller.

28. The device of claim 27, wherein the inverter synchronizes a falling edge of the horizontal synchronization signal with a falling edge of the pulse signal and synchronizes a rising edge of the horizontal synchronization signal with a rising edge of the pulse signal.

29. The device of claim 20, wherein the inverter controls the brightness of the backlight according to a brightness controlling signal.

30. The device of claim 20, wherein the inverter includes a switching transformer operated by the second power, which generates DC switching electric power according to the pulse signal.

* * * * *

UNITED STATES PATENT AND TRADEMARK OFFICE

CERTIFICATE OF CORRECTION

PATENT NO. : 7,348,959 B2
APPLICATION NO. : 10/849549
DATED : March 25, 2008
INVENTOR(S) : Eun-sup Kim It is certified that error appears in the above-identified patent and that said Letters Patent is hereby corrected as shown below:

Column 10, Line 2, after “power” delete “the”.

Signed and Sealed this

Second Day of September, 2008

JON W. DUDAS
*Director of the United States Patent and Trademark Office*